US006537131B1

(12) United States Patent
Larian

(10) Patent No.: US 6,537,131 B1
(45) Date of Patent: Mar. 25, 2003

(54) REALISTIC DOLL HEAD MOUNTING ASSEMBLY

(76) Inventor: Isaac Larian, 237 Carolwood, Los Angeles, CA (US) 90077

( * ) Notice: Subject to any disclaimer, the term of this patent is extended or adjusted under 35 U.S.C. 154(b) by 0 days.

(21) Appl. No.: 10/144,190

(22) Filed: May 13, 2002

(51) Int. Cl.[7] ..... A63H 3/36

(52) U.S. Cl. ..... 446/391; 446/376; 446/384

(58) Field of Search ..... 446/97, 268, 376, 446/378, 379, 383, 384, 391; 434/270, 395; 223/66

(56) References Cited

U.S. PATENT DOCUMENTS

| | | | | | |
|---|---|---|---|---|---|
| 1,270,781 | A | * | 7/1918 | Cabana | 446/383 |
| 1,292,113 | A | | 1/1919 | Smith | |
| 1,939,677 | A | | 12/1933 | Epstein | |
| 2,261,328 | A | | 11/1941 | Baum | |
| 2,552,216 | A | | 5/1951 | Rekettye | |
| 2,808,681 | A | | 10/1957 | Arenstein | |
| 3,124,901 | A | | 3/1964 | Beebe | |
| 3,273,280 | A | * | 9/1966 | Karton | 446/383 |
| 3,425,155 | A | | 2/1969 | Ryan et al. | |
| 4,137,115 | A | | 1/1979 | Lambert | |
| 4,143,453 | A | | 3/1979 | Taluba | |
| 4,190,982 | A | | 3/1980 | Rahmstorf | |
| 4,268,991 | A | * | 5/1981 | Cotey et al. | 446/373 |
| 4,968,282 | A | | 11/1990 | Robson et al. | |
| 5,628,669 | A | | 5/1997 | Hesse | |
| 6,086,447 | A | | 7/2000 | Tucker | |
| 6,328,625 | B1 | | 12/2001 | Lee et al. | |

* cited by examiner

*Primary Examiner*—Jacob K. Ackun
*Assistant Examiner*—Bena B. Miller
(74) *Attorney, Agent, or Firm*—Oppenheimer Wolff & Donnelly LLP

(57) ABSTRACT

A neck linkage is provided for coupling the head and upper torso of a doll together. The neck linkage includes a lower enlarged portion with a hole which receives a molded pin located adjacent the neck opening of the torso. The neck linkage further includes a hemispherical surface for engaging a mating hemispherical recess in the head and the neck linkage further includes upper depending arms which may be forced through a central recess in the hollow doll head and which extend downwardly to resiliently engage the inside of the doll's head and hold the position of the head in the preset location. The hemispherical recess at the base of the doll's head may include a slot to facilitate assembly of the neck linkage into the hollow doll head.

20 Claims, 2 Drawing Sheets

REALISTIC DOLL HEAD MOUNTING ASSEMBLY

FIELD OF THE INVENTION

This invention relates to arrangements for mounting a doll's head onto the torso of the doll.

BACKGROUND OF THE INVENTION

Various arrangements for mounting a doll's head on the torso of the doll have been proposed heretofore, as indicated in the following U.S. Patents.

Lee et al.
U.S. Pat. No. 6,328,625
Granted Dec. 11, 2001

Tucker
U.S. Pat. No. 6,086,447
Granted Jul. 11, 2000

Hesse
U.S. Pat. No. 5,628,669
Granted May 13, 1997

Robson et al.
U.S. Pat. No. 4,968,282
Granted Nov. 6, 1990

Rahmstorf
U.S. Pat. No. 4,190,982
Granted Mar. 4, 1980

Taluba
U.S. Pat. No. 4,143,453
Granted Mar. 13, 1979

Ryan et al.
U.S. Pat. No. 3,425,155
Granted Feb. 4, 1969

Beebe
U.S. Pat. No. 3,124,901
Granted Mar. 17,1964

However, the head mounting arrangements disclosed in these prior art patents are unduly limited and unrealistic in head movement in some cases, and are unduly complex or expensive to manufacture in other cases.

SUMMARY OF THE INVENTION

Accordingly, a principal object of the invention is to provide a head-to-torso doll mounting arrangement which is both realistic in its range of motion and which is simple and inexpensive to manufacture.

In accordance with one illustrative embodiment of the invention, the neck area of the torso of a doll is provided with an integrally molded transversely extending pin in the neck area, and a head-to-torso neck linkage member has a lower opening extending around said pin for providing limited movement of the neck linkage relative to the torso. The neck linkage member extends upward through a neck opening in the torso, and has a generally hemispherical surface for mating with a corresponding substantially hemispherical recess on the doll head. Above the hemispherical surface, the neck linkage has a protruding shaft from which two depending retention arms extend. The hemispherical recess in the dolls head has a central opening and a recess toward the rear thereof to facilitate snap insertion of the depending retention arms. The doll's head is hollow and is formed of somewhat resilient material, so that once the retention arms are inserted into the head, the two hemispherical surfaces engage, and the retention arms engage the inner surface of the hollow doll's head to bias the hemispherical surfaces toward one another.

The resultant available positioning of the doll's head relative to the torso corresponds fairly closely to that of a person, with the retention arms and the fairly loose fit of the pin with the hole in the linkage member, providing for simulated normal limited movement of the head and neck.

More generally, therefore, a doll assembly includes a transversely extending molded pin; and a neck linkage member includes an enlarged lower end having an opening through which said pin extends. The neck linkage member extends upward through a neck opening in the torso to a substantially hemispherical surface for engagement with a mating substantially hemispherical surface on the head. Finally the neck linkage has a shaft which extends through an opening in the hemispherical recess in the head, and is provided with downwardly extending retention arms for biasing the hemispherical surfaces together and for holding the head in desired positions relative to the torso.

The neck linkage member has a somewhat anchor like configuration with a shaft being enlarged at the lower end thereof, with a central opening, through the enlarged end; and having upper depending retention arms which are similar to the flukes of an anchor. In addition, the neck linkage is provided with the hemispherical surface intermediate the enlarged apertured end and the depending retention arms, for mating with a substantially hemispherical recess in the doll's head.

One aspect of the invention involves the upwardly extending shaft with the depending retention arms; with these arms having the resiliencing to bend inward when pressed through a small hole in the head, and expanding to bias the head toward the torso following snap insertion of the arms into the doll's head.

With regard to advantages as compared with the prior art, the use of a separate neck linkage is useful in providing more realistic available positions for the head; and the use of molded parts for the pin, head and linkage makes for a relatively simple and inexpensive assembly.

Other objects, features and advantages of the invention will become apparent from a consideration of the following detailed description and from the accompanying drawings. Accordingly, the present invention is not limited to the precise constructions shown in the drawings and described in detail hereinabove.

DETAILED DESCRIPTION OF THE PREFERRED EMBODIMENTS

While the specification describes particular embodiments of the present invention, those of ordinary skill can devise variations of the present invention without departing from the inventive concepts.

Figure 1:
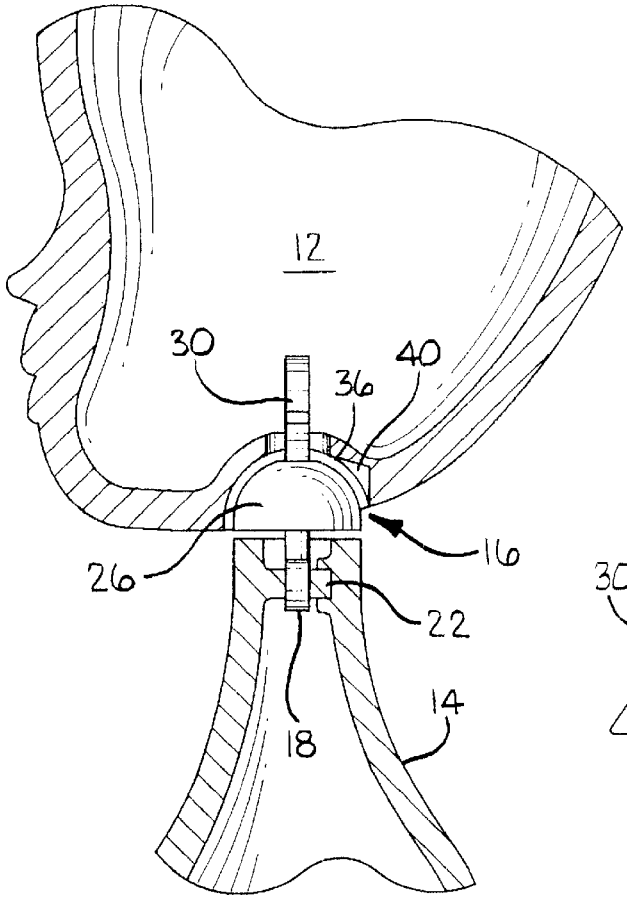
FIG. 1 is an assembly drawing showing the neck juncture between a doll's head and torso and the intermediate neck linkage, illustrating the principles of the invention.

Referring more particularly to the drawings, FIG. 1 shows in a partial cross-sectional the mounting arrangements between the head 12 of a doll and the torso 14, as well as the intermediate neck linkage member 16.

Figure 2:
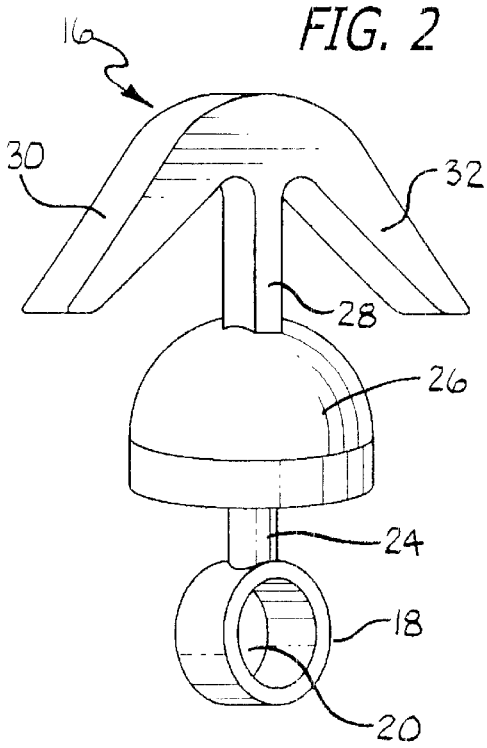
FIG. 2 is a perspective view of a neck linkage for coupling the head and torso of a doll.

FIG. 2 is an enlarged perspective view of the neck linkage 16 which is formed of flexible resilient material. It includes the enlarged portion 18 at the lower end thereof which has a hole 20 through which the pin 22 as shown in FIG. 1, extends. From the enlarged lower end portion 18, a shaft 24 extends upward to the enlarged portion 26 which has a generally hemispherical configuration. From the portion 26, a further shaft 28 extends upward to the top of the neck linkage from which the two resilient retention arms 30 and 32 extend.

Figure 3:
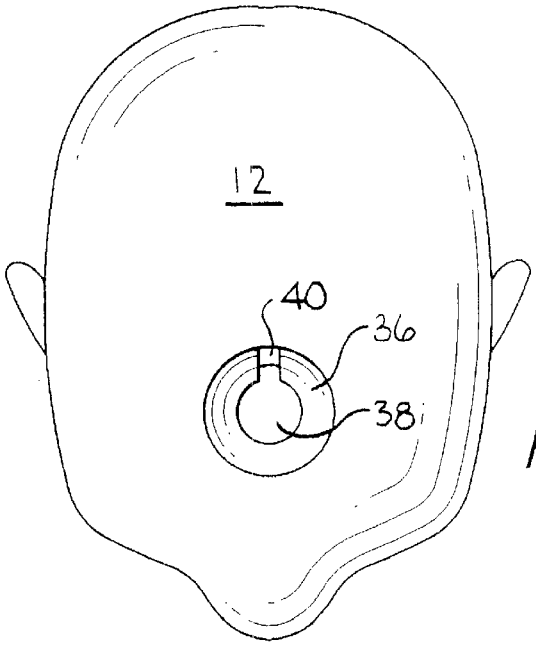
FIG. 3 is a view of a molded doll head taken from the bottom, and showing a hemispherical recess intended for mating with a hemispherical surface on the neck linkage member.

FIG. 3 is a bottom view of the head 12 of the doll showing a hemispherical recess 36 having a central hole 38 and a slot 40 extending partially through one of the side walls of the hemispherical recess 36.

Referring now back to FIG. 1 of the drawings, the pin 22 may be seen extending through the enlarged member 18 of the neck linkage, and the hemispherical surface 26 may be seen in a location where it would engage the hemispherical recess 36. One of the arms 30 of the neck linkage is also visible in FIG. 1. It may also be noted that in FIG. 1, a slight space is shown between hemispherical surfaces 26 and 36. However, in practice, resilient arms 30 and 32 exert a biasing force so that these two hemispherical surfaces would engage each other.

Incidentally, the torso 14 of the doll made of fairly stiff plastic, initially in two parts, with the pin 22 being molded with one of the two parts. Subsequently the linkage 16 is assembled to one side of the torso 14 with the opening 20 receiving the pin 22, and then the other portion of the torso 14 is assembled and engages the outer end of the pin 22. The two portions of the torso 14 are then sonicly welded together. The head 12 of the doll is preferably more flexible than the torso 15, and may be made of rubber or of a somewhat resilient plastic material. Following assembly of the neck linkage 16 by forcing the upper end thereof through the opening 38 with its recess 40, the depending tips of the arms 30 and 32 preferably engage the inner wall of the hollow doll head 12, and resiliently hold the head in any desired position, within the range of motion of assembly.

Incidentally, the range of motion of the doll's head relative to the torso substantially corresponds to the normal range of motion of a head and neck of a person. More specifically, the pin 22 makes a loose fit in the hole 20 in the enlarged member 18 of the neck linkage, and the mating hemispherical surfaces 26 and 36 permit limited motion of the head relative to the torso, with the tips of the depending arms 30 and 32 resiliently holding the head in the desired adjusted position relative to the torso.

Figure 4:
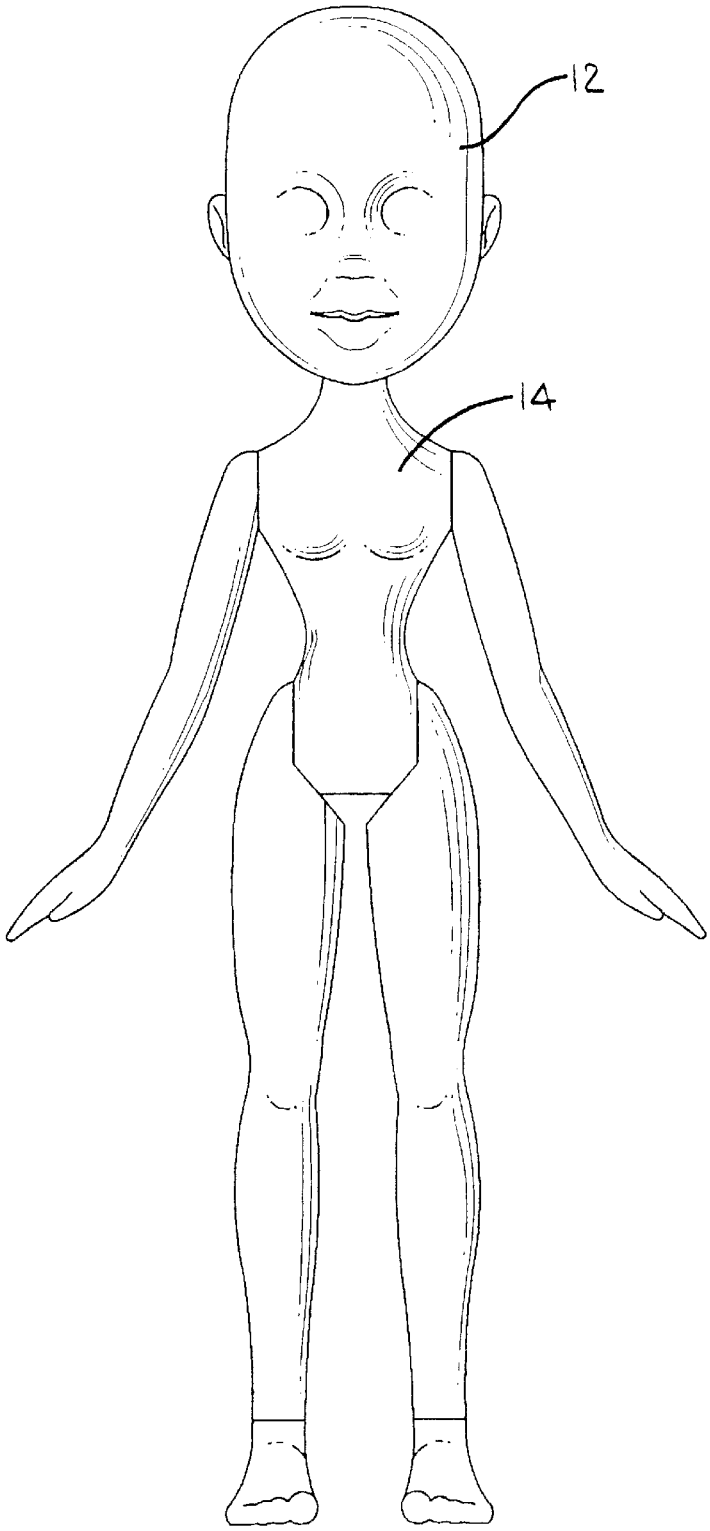
FIG. 4 is an overall view of a doll torso head and neck linkage.

For completeness, FIG. 4 shows the overall assembly of the doll torso and head, with the reference numerals 12 and 14 being carried only from FIGS. 1–3 being carried over to FIG. 4.

In closing, it is to be understood that the foregoing detailed description and the accompanying drawings relate to one preferred embodiment of the invention. Various changes and modifications may be made without departing from the spirit and scope of the invention. Thus, by way of example and not of limitation, the hole 38 may be made slightly larger or smaller, depending on the range of tilting of the head which is desired. In addition, instead of just two arms 30 and 32, an additional arm or arms may be added to provide further restriction on the movement of the head. Concerning materials, it is preferred that the head be of rubber or other resilient material, and that the torso of the doll be of fairly stiff plastic material. However, these may be changed, and any normal material employed in the fabrication of dolls or similar toys, may be employed. It is also noted that the neck lineage may be rigidly secured into said torso, or may be molded as part of said torso, although the fairly loose coupling disclosed in the drawings is preferred. Accordingly, the present invention is not limited to the specific embodiment as disclosed hereinabove and as shown in the drawings.

I is claimed is:

1. A doll neck linkage assembly comprising:

a molded doll torso having a neck opening and an integral molded pin extending transversely across said torso near said neck opening;

a neck linkage having an enlarged lower portion having a hole through said enlarged lower portion, said hole receiving said, pin;

said neck linkage having an intermediate substantially hemispherical surface;

a hollow doll head formed of flexible material having a substantially hemispherical recess for mating with said hemispherical surface on said neck linkage;

said recess having a central hole and a slot extending into the surface of said recess adjacent said hole;

said neck linkage having a shaft for extending through said central hole, the upper end of said shaft having two downwardly depending arms for resiliently engaging the inner surface of the hollow doll head; and said arms being flexible whereby they may be pressed through said central hole, facilitated by said slot, so that the upper end of said shaft and said depending arms may be assembled into said hollow doll head;

wherein said pin and linkage hole, together with said hemispherical surfaces and said depending arms provide a range of motion for said head and torso comparable to the normal human range of motion of the head and neck.

2. An assembly as defined in claim 1 wherein said torso is formed of stiff plastic material, and said head is formed of flexible material.

3. An assembly as defined in claim 1 wherein said neck linkage is formed of resilient material.

4. An assembly as defined in claim 1 wherein said torso is formed of two parts bonded together with said pin extending across between said two parts.

5. A doll neck linkage assembly comprising:

a doll torso having a neck opening and a pin extending transversely across said torso near said neck opening;

a neck linkage having an enlarged lower portion having a hole through said enlarged lower portion, said hole receiving said pin;

said neck linkage having an intermediate substantially hemispherical surface;

a hollow doll head having a substantially hemispherical recess for mating with said hemispherical surface on said neck linkage; said recess having a central hole;

said neck linkage having a shaft for extending through said central hole, the upper end of said shaft having at least two downwardly depending arms for engagement with the inner surface of the hollow doll head; and said arms being flexible whereby they may be pressed through said central hole, so that the upper end of said shaft and said depending arms may be assembled into said hollow doll head;

wherein said pin and linkage hole, together with said hemispherical surfaces and said depending arms provide a range of motion for said head and torso comparable to the normal human range of motion of the head and neck.

6. An assembly as defined in claim 5 wherein said torso is formed of stiff plastic material, and said head is formed of flexible material.

7. An assembly as defined in claim 5 wherein said neck linkage is formed of resilient material.

8. An assembly as defined in claim 5 wherein said torso is formed of two parts bonded together with said pin extending across between said two parts.

9. An assembly as defined in claim 5 wherein said pin is integrally molded with said torso.

10. A doll neck linkage assembly comprising:

a molded doll torso having a neck opening;

a neck linkage having a lower portion extending into and secured within said torso neck opening;

said neck linkage having an intermediate rounded surface;

a hollow doll head formed of flexible material having a rounded recess for mating with said rounded surface on said neck linkage; said recess having a central hole;

said neck linkage having a shaft for extending through said central hole, the upper end of said shaft having at least two downwardly depending arms for resiliently engaging the inner surface of the hollow doll head; and said arms being flexible whereby they may be pressed through said central hole, so that the upper end of said shaft and said depending arms may be assembled into said hollow doll head;

wherein said pin and linkage hole, together with said mating rounded surfaces and said depending arms provide a range of motion for said head and torso comparable to the normal human range of motion of the head and neck.

11. An assembly as defined in claim 10 wherein said torso is formed of stiff plastic material, and said head is formed of flexible material.

12. An assembly as defined in claim 10 wherein said neck linkage is formed of resilient material.

13. An assembly as defined in claim 10 wherein said neck linkage is secured into said torso with a limited range of motion.

14. An assembly as defined in claim 10 where said neck linkage has an opening in the lower end thereof, and a pin secured to said torso extends through said opening.

15. A doll neck linkage assembly comprising:

a molded doll torso having a neck area;

a neck linkage having a lower portion secured to the neck area of said torso;

said neck linkage having an intermediate rounded surface;

a hollow doll head formed of flexible material having a rounded recess for mating with said rounded surface on said neck linkage; said recess having a central hole;

said neck linkage having a shaft for extending through said central hole, the upper end of said shaft having at least two downwardly depending arms for resiliently engaging the inner surface of the hollow doll head; and said arms being flexible whereby they may be pressed through said central hole, so that the upper end of said shaft and said depending arms may be assembled into said hollow doll head;

wherein said mating rounded surfaces and said depending arms provide a range of motion for said head and torso comparable to the normal human range of motion of the head and neck.

16. An assembly as defined in claim 15 wherein said torso is formed of stiff plastic material, and said head is formed of flexible material.

17. An assembly as defined in claim 15 wherein said neck linkage is formed of resilient material.

18. An assembly as defined in claim 15 wherein said neck linkage is secured into said torso with a limited range of motion.

19. An assembly as defined in claim 15 where said neck linkage has an opening in the lower end thereof, and a pin secured to said torso extends through said opening.

20. An assembly as defined in claim 15 wherein said rounded surfaces are substantially hemispherical.

* * * * *